United States Patent [19]

Shine

[11] Patent Number: 5,002,270

[45] Date of Patent: Mar. 26, 1991

[54] EXERCISE VEST

[76] Inventor: Anthony G. Shine, 8159 Mandalay, Detroit, Mich. 48204

[21] Appl. No.: 468,196

[22] Filed: Jan. 22, 1990

[51] Int. Cl.[5] ..... A63B 21/065

[52] U.S. Cl. ..... 272/119; 2/102

[58] Field of Search ..... 272/117, 119, 143; 2/2.5, 79, 81, 93, 94, 102

[56] References Cited

U.S. PATENT DOCUMENTS

| | | | |
|---|---|---|---|
| D. 274,194 | 6/1984 | Rutty . | |
| 3,529,307 | 9/1970 | Belson et al. | 2/94 |
| 3,843,969 | 10/1974 | George et al. | 2/2.5 |
| 3,950,789 | 4/1976 | Konz et al. | 2/93 |
| 4,041,549 | 8/1977 | Atkinson | 2/94 |
| 4,055,853 | 11/1977 | Argento et al. | 2/93 |
| 4,247,097 | 1/1981 | Schwartz | 272/119 |
| 4,268,917 | 5/1981 | Massey | 2/102 |
| 4,302,847 | 12/1981 | Miles | 2/2 |
| 4,332,379 | 6/1982 | Bannister | 272/119 |
| 4,344,620 | 8/1982 | Debski | 8/82 |
| 4,382,302 | 5/1983 | Watson | 272/119 X |
| 4,384,369 | 5/1983 | Prince | 2/79 |
| 4,601,067 | 7/1986 | Buonassissi | 2/102 |
| 4,602,387 | 7/1986 | Zakrzewski | 2/102 |
| 4,658,442 | 4/1987 | Tomlinson et al. | 2/94 |
| 4,669,127 | 6/1987 | Swanson | 2/46 |

FOREIGN PATENT DOCUMENTS

| | | | |
|---|---|---|---|
| 23806 | of 1914 | United Kingdom | 2/102 |
| 2139103 | 11/1984 | United Kingdom | 272/119 |

*Primary Examiner*—Robert Bahr

*Attorney, Agent, or Firm*—Basile and Hanlon

[57] ABSTRACT

An exercise vest is provided which comprises a body having a front, a back and two sides, all connected at the sides and the front to define an internal cavity. The vest is adjustable such that the diameter of the internal cavity may expand or retract to conform the vest to various users. A plurality of pockets are attached to the body and weights are receivable in the pockets. A pair of vertically spaced, co-linear pockets are formed on each of the first and second sections of the front of the body. A pair of horizontally spaced pockets are formed on the back of the body. The pockets are of substantially the same size and receive identical weights to provide a 2:1 front to back weight distribution on the vest. The weights are preferably formed of loose lead shot mounted in containers insertable into each of the pockets. The pockets are releasably closable and flaps are associated with at least one of the pockets.

7 Claims, 1 Drawing Sheet

EXERCISE VEST

BACKGROUND OF THE INVENTION

1. Field of the Invention

The present invention generally relates to exercise garments and, more particularly, is concerned with an exercise vest which can enhance a workout.

2. Description of the Relevant Art

In recent years, there has been a substantial increase in health consciousness. People of all ages now wish to look and feel healthy, trim and fit. As a result of this, there is an increased need for various exercise equipment. Any such equipment involving weights is especially popular.

The use of weights in a workout has been found to quickly tone and develop muscles, as well as provide great aerobic benefits. However, there are several problems inherent in the use of weight equipment. This equipment is often very expensive, space consuming and immobile. For these reasons, many people resort instead to exercises such as jogging, walking and bicycling. Yet these people also would like to enjoy the added benefit obtained from working out with weights.

Various vests and jackets have been devised to carry weights and to mount such weights about the upper body or torso of a user. Such vests and jackets are provided with various receptacles, such as pockets, chambers, etc., which removably or permanently retain weights, such as sand, water, etc. Such vests and jackets have been provided in numerous configurations; but all are directed to equal weight distribution about the upper torso of the body of a user.

Garments have also been constructed with a plurality of pockets mounted at diverse locations on the outer surface of the jacket for receiving special items, such as body armor, camping and hiking utensils and combat equipment. However, such vests and jackets are directed to a single purpose and are not specifically designed for carrying weight in a balanced, non-movable manner.

Consequently, it would be desirable to provide a more economical, mobile, easily stored weight unit, such as a garment, which can be used by people when exercising. It would also be desirable to provide a garment which can adjust to users of various sizes and removably receive various weights.

SUMMARY OF THE INVENTION

The present invention provides an exercise vest designed to solve the above-mentioned problems. The exercise vest comprises a body having a front formed of first and second sections, a back and two sides. Means are provided for releasably connecting the first and second sections of the front of the body together. Means are also provided for adjustably connecting the sides together to define an internal cavity within the body having a variably adjustable diameter. A first pair of vertically spaced co-linear pockets are mounted on the first section of the front of the body. A second pair of vertically spaced, co-linear pockets are formed on the second section of the front of the body. A third pair of horizontally spaced pockets are formed on the back of the body. Weights are disposed in the first, second and third pair of pockets, the total weight in the first and second pair of pockets on the front of the body being twice the total weight in the third pair of pockets on the back of the body. Means are provided for releasably closing all of the pockets of the first, second and third pair of pockets.

The weights, the means for connecting the first and second sections of the front of the body together, and the means for adjustably connecting the sides together cooperate to snugly mount the body on the user without movement during activity of the user.

In a preferred embodiment, the weights comprise loose lead shot which may be loosely disposed in each of the pockets or in individual containers. The containers may preferably be sealingly closed or may have an openable end to permit lead shot to be added to or removed from each of the containers so as to vary the total weight in each container.

The vest of the present invention is mountable on the upper torso of the body of a user and, despite the 2:1 weight distribution from the front to the back of the vest, remains in place without sag or movement during any activity of the user. Most of the weight is situated about the bottom of the vest or near the waist of the user when the vest is worn on the upper torso of the user.

The exercise vest of the present invention is more economical than conventional weight equipment and is mobile and easily stored. The amount of the weight in the vest may be varied, and the vest itself is adjustable in diameter such that many different users may get a secure fit without fear of the vest shifting during use.

BRIEF DESCRIPTION OF THE DRAWINGS

The various features, advantages and uses of the present invention will become apparent to those skilled in the art by reference to the following detailed description and drawings, in which.

DESCRIPTION OF THE PREFERRED EMBODIMENTS

Figure 2:
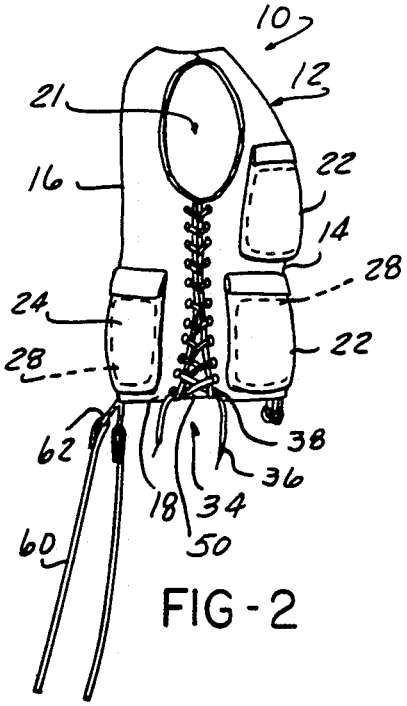
FIG. 2 is a side view of one embodiment of the present invention.
Figure 1:
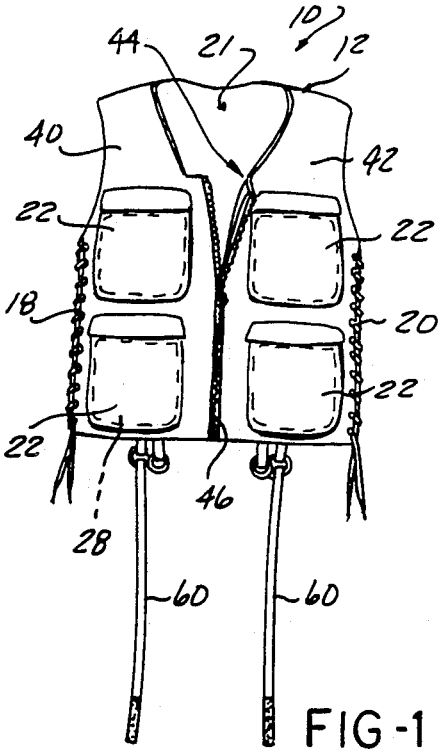
FIG. 1 is a front view of one embodiment of the vest of the present invention.

Referring now to the drawings, and more particularly to FIGS. 1 and 2, there is shown an exercise vest designated by reference numeral 10. The vest 10 comprises a body 12 which has a front 14, a back 16, and two sides 18 and 20. Front 14, back 16 and sides 18, 20 are all connected to define an internal cavity 21.

The vest 10 further comprises means 34 mounted on the body 12 for adjusting the diameter of the internal cavity 21. This adjusting means 34 allows the vest 10 to conform to the torso size of many different users, as well as allowing for varying degrees of tightness on a single user. A piece of material 50 may be secured at side 18 between facing edges of a front section 40 and back 16. A piece of material 50 may be similarly secured at side 20. In one embodiment of the present invention, the adjusting means 34 comprises a mating tie 36 and eyelet 38. As shown in FIG. 1, the front 14 of the body 12 includes two spaced first and second sections 40 and 42, respectively. Adjusting means 34 is located at side 18 and draws section 40 closer to, or farther apart from, back 16. Adjusting means 34 located at side 20 draws section 42 closer to, or farther from, back 16. It will also be understood that the adjusting means 34 may be fashioned out of any suitable fastening device, including mating hooks and loops, commonly known as VELCRO, and may be located in any suitable area on body 12.

The vest 10 further comprises means 44 for releasably securing one front section 40 to the other front section 42. In the preferred embodiment, as shown in FIG. 1, a zipper 46 attached to the facing edges of the front sections 40 and 42 comprises the securing means. This provides a very secure fit, with little or no chance of accidental opening during use. It is to be understood that this is merely an example, and that other securing means, such as VELCRO fasteners, D-hooks and straps, etc., may be used.

A plurality of pockets 22, 24 are attached to the body 12. The pockets 22, 24 receive weights 28 shown in phantom. Flaps 30 associated with at least one and preferably all of the pockets 22, 24 are provided, as most clearly shown in FIG. 3. The pockets 24 include means 32 for releasably closing the pocket 24.

The location and number of the pockets 22, 24 on the vest 10 are chosen for balance and weight distribution. Thus, in a preferred embodiment, each of the front sections 40 and 42 on the body 12 includes a pair of vertically spaced, co-linear pockets 22, as shown in FIGS. 1 and 2. The pockets 22 are of identical size and shape and are located in line with each other both vertically and horizontally, for even weight distribution on the front 14 of the body 12. By way of example only, each of the pockets 22 has a size of four inches in height and five inches in width. This is by way of example only as other sizes for the pockets 22 may also be selected depending upon the intended use of the vest 10 and/or the size of the intended user.

Figure 3:
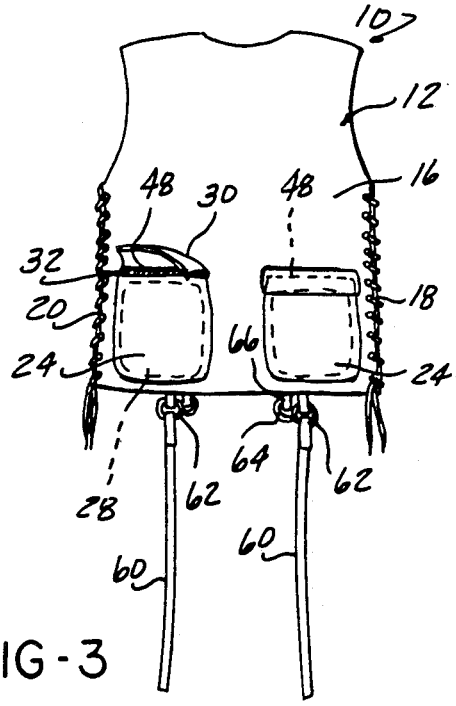
FIG. 3 is a rear view of one embodiment of the present invention.
Figure 4:
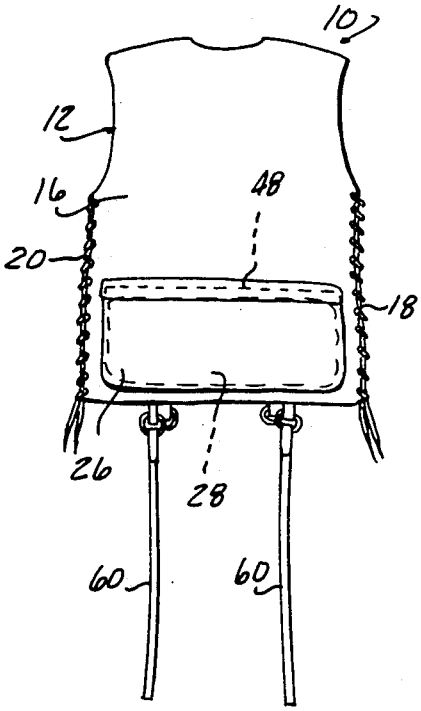
FIG. 4 is a rear view of a second embodiment of the present invention.

The back 16, in one embodiment, has one large pocket 26 attached to and extending across, substantially the entire width of the back 16, as seen in FIG. 4. However, in the preferred embodiment shown in FIG. 3, a pair of identically shaped pockets 24 are equidistantly spaced on the back 16 of the body 12. The pockets 24 are horizontally in line with the bottom-most pockets 22 on the front 14 of the body 12. The pockets 24 have the same preferred shape as the pockets 22; although each pocket 24 preferably has a four inch height and a six inch width.

The pocket closing means 32 may comprise any suitable fastening means. Pocket closing means 32 may be used on any or all pockets 22, 24, but for clarity, only pocket 24 will be discussed. In the preferred embodiment, as best seen in FIG. 3, a zipper 48 may be seen releasably closing pocket 24. The zipper 48 securely closes pocket 24 with little chance of any weights 28 accidentally falling out of pocket 26 during use. In another embodiment, mating hooks and loops, such as that sold under the trademark VELCRO, are mounted inside the top of pocket 24. The pocket closing means 32 enables the user to keep a weight 28 from falling out of the pocket 24 during periods of exercise.

Flaps 30 are provided as optional for the pocket closing means 32. If a user forgets to secure pocket 24, flaps 30 will prevent weights 28 from leaving the pocket 24 in an upward manner since the flaps 30 are stitched on the top and both sides to the body 12. This could prevent injury to a user, since a weight 28 flying upward and outward from pocket 24 could hit a user. Additionally, flap 30 is a pleasing design feature in that it hides any pocket closing means 32. For this purpose, the flap 30 may be stitched along the top of the pocket 24, as shown in FIG. 3, or it may be stitched on the top and two sides of the pocket 24, as in the preferred embodiment.

Some users of the vest 10 may optionally need to have the vest 10 secured at the lower end by something similar to a crotch strap, in order to prevent the vest 10 from riding up a person's body during use. It would also prove to be more comfortable if the vest 10 were not bouncing up and down. For this purpose, any suitable means may be used. The embodiments shown in the drawings use straps 60 for this purpose. There are two straps 60 shown in the figures, but since straps 60 are identical in structure and use, only one strap 60 will be described. The strap 60 is adjustably extendable between the front 14 and back 16 of the body 12. As shown in FIG. 2, strap 60 is attached to the back 16. Strap 60 is extendable through a user's crotch area, and may be attached to the front 14. The strap 60 is attached to the back 16 by D hook 62. D hook 64 is attached to strap 66, which is attached to front 14. Strap 60, when looped through D Hook 64 and then secured to itself with mating hooks and loops, commonly known by the trade name VELCRO, secures the lower end of back 16 to the lower end of front 14 in a fashion similar to the engagement of strap 50 with D hook 48 to secure front sections 40 and 42 together.

Weights 28, shown in phantom in FIGS. 1 through 4, may be of any type and configuration. In a preferred embodiment, the weight 28 comprises lead shot having a predetermined total weight. The individual user would choose a particular weight according to his own need. The weights 28 may be put in the pockets 22, 24 loose or in bags; not shown. The bags mays be stitched or otherwise sealingly and permanently closed to retain the lead shot therein. Alternately, the bags may have an openable end to enable lead shot to be added or removed from each of the bags to thereby vary the amount of weight contained within each bag.

It has been uniquely found that a predetermined weight distribution may be employed on the vest 10 which permits the vest 10 to be securely mounted about the upper torso of a user without sag or movement during activity of the user while wearing the vest 10. Due to the substantially identical size and shape of the pockets 22 and 24, it is preferred that an identical weight 28 be disposed within each of the pockets 22 and 24 on the front and back sections 14 and 16, respectively, of the body 12 of the vest 10. In a preferred embodiment, a weight 28 formed of lead shot having a total weight of 3½pounds is disposed loosely or in a bag in each of the pockets 22 and 24. This provides fourteen pounds of total weight on the front 14 of the body 12 and seven pounds of weight on the back 16 of the body 12. The weight on the front 14 of the body 12 is evenly distributed due to the vertical, co-linear arrangement of the pockets 22 on each of the front sections 40 and 42. Further, due to the horizontal alignment of the bottom-most pockets 22 on the front 14 of the body 12 with the pockets 24 on the back 16 of the body 12, most of the weight on the vest 10 is centered about the bottom of the vest 10 or near the waist of the user. This 2:1 weight distribution in combination with the adjusting means 34 and the securing means 44 enables the vest 10 to be snugly and immovably mounted about the upper torso of a user without sag or movement during activity of the user. This lack of movement of the vest 10 occurs despite the 2:1 weight distribution with more weight on the front 14 than on the back 16 of the body 12.

In summary, there has been disclosed a unique exercise vest which may be adjusted in size to fit numerous users and which does not move or sag during activity of the user.

What is claimed is:

1. An exercise vest comprising:

a body having a front formed of first and second sections, a back, and two sides;

means for releasably connecting the first and second sections of the front of the body together;

means for adjustably connecting the sides together to define an internal cavity within the body having a variably adjustable diameter;

a first pair of vertically spaced, co-linear pockets mounted on the first section of the front of the body;

a second pair of vertically spaced, co-linear pockets formed on the second section of the front of the body;

a third pair of horizontally spaced pockets formed on the back of the body, the third pair of pockets on the back of the body being substantially horizontally aligned with the bottom-most ones of the pockets in each of the first and second pairs of pockets mounted on the front of the body;

weights disposed in the first, second and third pair of pockets, the weights formed of a predetermined quantity of lead shot;

the total weight of the weights in the first and second pair of pockets on the front of the body being twice the total weight of the weights in an third pair of pockets on the back of the body, wherein the total weight on the front of the body is twice the total weight on the back of the body;

the weights, the means for connecting, and the means for adjustably connecting cooperating to snugly mount the body on the user without movement during activity of the user; and means for releasably closing all of the pockets of the first, second and third pairs of pockets.

2. The exercise vest of claim 1 wherein the pocket closing means comprises a zipper mounted on each pocket.

3. The exercise vest of claim 1 wherein the pocket closing means comprising mating hook and loop fasteners.

4. The exercise vest of claim 1 further comprising:

a flap mounted on the body and overlaying the pocket closing means of at least one of the pockets of the first, second and third pairs of pockets.

5. The exercise vest of claim 1 further comprising:

container means for receiving the weights, the container means being removably insertable into each of the pockets of the first, second and third pairs of pockets.

6. The exercise vest of claim 5 wherein the container means is closed.

7. The exercise vest of claim 5 wherein the container means is closably openable.

* * * * *